US005111774A

United States Patent [19]

Hiramoto et al.

[11] Patent Number: 5,111,774

[45] Date of Patent: May 12, 1992

[54] ENGINE COOLING SYSTEM

[75] Inventors: Nobuo Hiramoto, Akitsu; Seiji Nanba, Fuchu; Soichiro Ogawa, Hiroshima; Osamu Nozaki, Hiroshima, all of Japan

[73] Assignee: Mazda Motor Corporation, Hiroshima, Japan

[21] Appl. No.: 587,842

[22] Filed: Sep. 25, 1990

[30] Foreign Application Priority Data

Sep. 25, 1989 [JP] Japan ..... 1-111783[U]
Sep. 27, 1989 [JP] Japan ..... 1-113144[U]
Sep. 27, 1989 [JP] Japan ..... 1-113145[U]

[51] Int. Cl.[5] ..... F01P 7/14
[52] U.S. Cl. ..... 123/41.1; 123/41.01
[58] Field of Search ..... 123/41.01, 41.08, 41.09, 123/41.1, 41.11, 41.29, 41.72

[56] References Cited

U.S. PATENT DOCUMENTS 2,346,051 4/1944 Seamark ..... 285/918
3,255,740 6/1966 Walsh ..... 123/41.09
4,513,695 4/1985 Patchen, II ..... 123/41.1
4,745,885 5/1988 Koinuma ..... 123/41.08
4,938,185 7/1990 Doke ..... 123/41.08

FOREIGN PATENT DOCUMENTS 62-91615 4/1987 Japan .
1-170710 7/1989 Japan ..... 123/41.01
6413423 5/1965 Netherlands ..... 285/918

*Primary Examiner*—Noah P. Kamen
*Attorney, Agent, or Firm*—Wenderoth, Lind & Ponack

[57] ABSTRACT

An engine cooling system includes an engine body or block having a plurality of cylinder banks, a plurality of water jackets communicated with each other for individually cooling the cylinder banks, a cooling water passage including a plurality of branch portions respectively connected to the water jackets and a joining portion convergently continued from the branch portions, and a cooling water filler provided on the joining portion at a position near one of the cylinder banks. Accordingly, the height of an engine hood of a vehicle can be effectively reduced, and in the case of filling cooling water into the filler, air in the water jackets can be smoothly expelled, thus improving water filling ability by a simple and low-cost construction.

43 Claims, 7 Drawing Sheets

ENGINE COOLING SYSTEM

BACKGROUND OF THE INVENTION

1. Field of the Invention

The present invention relates to an engine cooling system, and more particularly to a cooling system for a multi-cylinder V-type transverse water-cooled engine.

2. Description of the Prior Art

U.S. patent application Ser. No. 439,917 filed Nov. 21, 1989 relates to a cooling system for the above type engine. Such an engine cooling system still has the following problems.

First, the following problem remains concerning a cooling water filling position.

In a cooling system for a water-cooled engine, it is generally necessary to locate a cooling water filler at the highest position of an overall cooling water circulation path. Conventionally, as an upper end of a radiator is present at the highest position of the overall cooling water circulation path, the cooling water filler is located at the upper end of the radiator.

In recent years, it has been demanded to reduce the height of an engine hood of a vehicle. In such a vehicle having a low engine hood, the height of the engine hood is lowest especially in the vicinity of a front end portion of the vehicle. Accordingly, it is necessary to reduce the height of the radiator which is normally located at the front end portion of the vehicle. However, if the upper end of the radiator is present at the highest position of the overall cooling water circulation path, the height of the engine hood of the vehicle cannot be sufficiently reduced. The height of the radiator can be reduced so as not to locate the upper end of the radiator at the highest position of the overall cooling water circulation path. In such case, the cooling water filler cannot be located at the upper end of the radiator.

In this circumstance, there has been proposed an engine cooling system wherein the cooling water filler is located on a cooling water passage communicating the radiator with a water jacket of the engine (see Japanese Patent Laid-open Publication No. 58-210314, for example). In such case, that portion of the cooling water passage where the cooling water filler is located should be located at the highest position of the overall cooling water circulation path. In such a cooling system, since it is not necessary to locate the upper end of the radiator at the highest position of the overall cooling water circulation path, the height of the radiator can be sufficiently reduced. Accordingly, the height of the engine hood of the vehicle can be effectively reduced.

Meanwhile, in a water-cooled multi-cylinder engine having a plurality of cylinder banks, such as a V-type engine, a water jacket is normally formed in each bank. A plurality of cooling water outlet passages for discharging cooling water in the water jackets in the banks are converged at a joining portion which is continued to a common cooling water outlet passage. The common cooling water outlet passage is connected to the radiator (see Japanese Patent Laid-open Publication No. 62-91615). In such an engine cooling system, the diameter of each cooling water outlet passage connected to each bank is smaller than that of a single cooling water outlet passage in a normal in-line engine (having a single bank) having multiple cylinders arranged rectilinearly. In a V-type engine, the amount of the cooling water to be discharged from the water jacket in each bank is about ½ of the amount of the cooling water to be discharged from all the water jackets. Therefore, the cross sectional area of each cooling water outlet passage from each bank in the V-type engine is about ½ of the cross sectional area of the cooling water outlet passage in the in-line engine.

In such a V-type engine, it is normal to locate the cooling water filler at either the upper end of the radiator or on the common cooling water outlet passage so as to reduce the height of the engine hood. In any case, when cooling water is filled from the cooling water filler into the cooling system after draining the cooling system, the cooling water filled from the cooling water filler is divided from the common cooling water outlet passage to the cooling water outlet passages leading to the respective water jackets in the banks. However, since the cross sectional area of each cooling water outlet passage leading to each water jacket is relatively small as mentioned above, the cooling water flowing into the water jackets interferes with inside air that must be expelled from the water jackets to the cooling water outlet passages. As a result, the inside air is not smoothly expelled and a long time is required for filling the cooling water into the water jackets.

To cope with this problem, it has been considered to enlarge the diameter of each cooling water outlet passage for each bank. However, this causes other problems in relation to cost and space around the engine. Alternatively, it has been considered to provide an air vent through the water jacket in each bank. However, this causes an increase in number of parts, resulting in problems in relation to mountability and cost.

Second, the following problem remains concerning workability, serviceability, sealability and durability of a mounting structure of the cooling water circulation system.

Generally, a cooling system for a water-cooled engine includes a water pump for supplying cooling water to the engine, a cooling water outlet passage for guiding the cooling water from the engine to the radiator, a water return passage for returning the cooling water from the radiator to the engine, a thermostat case connected to a downstream end of the water return passage, a suction passage for communicating a suction side of the water pump with the thermostat case, and a bypass passage for communicating the cooling water outlet passage with the thermostat case.

Particularly in a V-type engine, in order to make the cooling system compact, the water pump is located at a front end of the engine, and the thermostat case is located at a rear end of the engine. Furthermore, the suction passage for connecting the water pump with the thermostat case is located in a V-shaped space defined between two banks, which space is a dead space in the prior art (see Japanese Patent Laid-open Publication No. 62-91615, for example).

In such a cooling system wherein the suction passage is located in the V-shaped space, if the suction passage is fixedly connected at opposite ends thereof to the water pump and the thermostat case, both of which are fixed to the engine, and the engine and the suction passage are formed for example of aluminum alloy and steel material, respectively, strong internal stresses will be generated in the engine or the suction passage in the longitudinal direction thereof when temperature changes occur due to a difference in coefficients of thermal expansion of the materials of the engine and the suction passage. This causes a reduction in durability and sealability of the engine and the cooling system. Such problem also can occur because of errors in dimensions of the suction passage.

In the above conventional cooling system described in Japanese Patent Laid-open Publication No. 62-91615, for example, the opposite ends of the suction passage are displaceably connected through O-rings to the water pump and the thermostat case, so as to prevent the generation of internal stresses due to temperature changes or dimensional errors.

However, as the O-rings are used for the connection of the suction passage in the above conventional cooling system, the number of parts is increased to cause more complexity of mountability and serviceability. Furthermore, the O-rings are hard to position.

Third, the following problem remains concerning cooling performance of the radiator and noise to be generated from a cooling fan.

Generally in a vehicle provided with a water-cooled transverse engine, the radiator is located in the vicinity of a front end of the vehicle in such a manner that a wind receiving surface of the radiator is substantially perpendicular to a longitudinal direction of the vehicle. On the other hand, the engine is located behind the radiator so as to extend in a transverse direction of the vehicle. Further, a motor-driven cooling fan is located just behind the radiator, so as to facilitate the cooling performance of the radiator.

Meanwhile, it has been demanded in recent years to reduce the height of the radiator in relation to the fact that a vehicle with a low engine hood is preferred. To meet this demand, it has been proposed that a vehicle having a transverse engine be provided with a cross flow type radiator having a pair of cooling water tanks located at opposite ends of a radiator body portion, in the transverse direction of the vehicle (see Japanese Patent Laid-open Publication No. 62-91615, for example). In the prior art, such cooling water tanks are located at an upper end and a lower end of the radiator body portion.

However, in such vehicle having the water-cooled transverse engine, the projected area of the engine in the air flowing direction (i.e., the longitudinal direction of the vehicle) is very large. Accordingly, the blowing ability or performance of the cooling fan is hindered by the engine, with the result that the cooling performance of the radiator is reduced.

Further, a cooling water passage for circulating the cooling water between the engine and the radiator is located behind the cooling fan. As a result, the blowing ability of the cooling fan is further hindered by the cooling water passage, thereby further reducing the cooling performance of the radiator. Furthermore, as the air fed from the cooling fan flows around the cooling water passage at a high velocity, a so-called wind noise is generated to cause a large noise of the cooling fan.

SUMMARY OF THE INVENTION

It is a first object of the present invention to provide a cooling system for a multi-cylinder V-type transverse water-cooled engine which can effectively reduce the height of an engine hood of a vehicle and can smoothly expel air in the water jacket of the engine when filling cooling water therein, thus improving water filling ability with a simple and low-cost construction.

It is a second object of the present invention to provide a cooling system for the above-mentioned engine which has a compact structure and can improve mountability, serviceability, sealability and durability of a mounting structure of a cooling water circulation system.

It is a third object of the present invention to provide an engine cooling system which can improve cooling performance of a radiator even though it is applied to a transverse water-cooled engine, and can reduce noise to be generated from a cooling fan.

According to the present invention for achieving the first object, there is provided an engine cooling system comprising an engine body having a plurality of cylinder banks; a plurality of water jackets communicated with each other for individually cooling the cylinder lines banks, a cooling water passage comprising a plurality of branch portions respectively connected to the water jackets and a joining portion convergently continued from the branch portions, and a cooling water filler provided on the joining portion at a position near one of the cylinder banks.

With this construction, as the cooling water filler is provided on the joining portion of the cooling water passage, it is not necessary to locate the upper end of the radiator at the highest position of the overall cooling water circulation path. Accordingly, the height of the radiator can be sufficiently reduced.

Furthermore, in the case that the engine body having a plurality of cylinder banks is a V-type engine body as a typical example, the V-type engine body has a pair of first and second cylinder banks In such a V-type engine body, the cooling water filler is located at a position near the first bank. Accordingly, in filling cooling water from the cooling water filler, substantially all the cooling water is allowed to flow into the water jacket in the first bank. As the water jacket in the first bank is communicated with the water jacket in the second bank at respective lower portions thereof, air inside the water jacket in the first bank having a volume corresponding to that of the cooling water filled into the water jacket in the first bank is smoothly expelled through the water jacket in the second bank and the cooling water passage (in which no cooling water flows) from the cooling water filler to the atmosphere. Accordingly, the cooling water filled from the cooling water filler does not interfere with the inside, air but rather flows smoothly into the water jacket in the first bank. After being filled into the water jacket in the first bank, the cooling water is allowed to flow through the communicated portion between both the water jackets into the water jacket in the second bank, and thereafter to flow into the radiator and the other cooling water circulation passages.

Thus, a reduction in height of the engine hood of the vehicle and an improvement in water filling ability of the cooling system cab be achieved effectively by a simple construction such that the cooling water filler is located on the joining portion of the cooling water passage at a position near the first bank.

The joining portion of the cooling water passage has a portion located at a position higher than that of the branch portions of the cooling water passage, and the cooling water filler is provided at such higher portion.

The portion where the cooling water filler is provided is located at the highest position of an overall cooling water circulation path.

The cooling water filler is located near one of the cylinder banks, so as to admit a cooling water into one of the water jackets for cooling such one cylinder bank near the cooling water filler and expel inside air from the other water jackets for cooling the other cylinder lines.

The cooling water filler is mounted on an upper surface of the joining portion of the cooling water passage.

The engine cooling system further comprises a cap for openably closing the cooling water filler.

Each of the water jackets is formed continuously in a cylinder block and a cylinder head which constitutes each of the cylinder banks, the cylinder head has a cooling water outlet port for discharging cooling water from each water jacket, and each of the branch portions of the cooling water passage is connected to a respective cooling water outlet port.

The cooling water outlet ports are formed close to each other between the cylinder banks.

The joining portion of the cooling water passage is connected to the radiator.

The joining portion of the cooling water passage is connected to a bypass passage bypassing the radiator and connected to the cylinder block of each cylinder bank.

The engine body is a V-type engine body having a pair of cylinder banks, each of the water jackets is formed in a respective of the banks, the joining portion of the cooling water passage has a portion located at the highest position of the overall cooling water circulation path, and the cooling water filler is provided at the highest portion of the cooling water passage at a position close to one of the banks, so as to admit cooling water into the water jacket in such one bank and expel inside air from the water jacket in the other bank.

The engine cooling system further comprises a thermostat case provided at one end of the engine body in an axial direction of a crankshaft thereof, a water pump and a cooling water outlet port provided at the other end of the engine body in the axial direction of the crankshaft, a suction pipe provided to extend along the crankshaft for connecting the thermostat case to the water pump, a bypass pipe provided to extend along the crankshaft for connecting the thermostat case to the cooling water outlet port, the thermostat case, the suction pipe and the bypass pipe being constructed as an integrated assembly, fastening means for mounting such assembly to one end of the engine body, a suction pipe connecting member for connecting the suction pipe to the water pump so as to allow the suction pipe to be displaceable in the axial direction of the crankshaft, and a bypass pipe connecting member for connecting the bypass pipe to the cooling water outlet port so as to allow the bypass pipe to be displaceable in the axial direction of the crankshaft.

The engine cooling system further comprises the crankshaft provided in the engine body and extending in a transverse direction of the vehicle, a cross flow type radiator provided forwardly of the engine body in offset relatonship relative to the engine body in the transverse direction of the vehicle, the radiator having a cooling wind receiving portion extending in the transverse direction of the vehicle and having a pair of first and second cooling water tanks located at opposite ends of the cooling wind receiving portion in the transverse direction of the vehicle, a cooling fan mounted through a stay to a rear surface of an offset portion of the radiator behind which the engine body is not located, and a pair of first and second cooling water pipes for connecting the engine body to the first and second cooling water tanks, respectively of the radiator, the first cooling water pipe being located between an upper end portion of the first cooling water tank and an upper portion of the engine body, while the second cooling water pipe located between a lower end portion of the second cooling water tank and the upper portion of the engine body so as to extend along the stay.

According to the present invention for achieving the second object, there is provided an engine cooling system comprising a thermostat case provided at one end of an engine body in an axial direction of a crankshaft thereof, a suction pipe having one end connected to the thermostat case and the other end connected to a water pump, and a bypass pipe having one end connected to the thermostat case and the other end connected to a cooling water outlet port formed in the engine body, wherein the thermostat case, the suction pipe and the bypass pipe are constructed as an integrated assembly, i.e. are connected together so as to be mountable on the engine as a unit.

With this construction, the thermostat case, the suction pipe and the bypass pipe are integrated to form the assembly having a compact structure. Accordingly, the cooling system can be made compact.

The engine cooling system further comprises fastening means for mounting the assembly to the engine body.

The fastening means comprises a bolt extending from the one end of the engine body toward the other end in the direction of the crankshaft for fastening the thermostat case to a wall surface of the one end of the engine body.

As the thermostat case of the assembly is fastened to the engine body by means of the bolt only, the mountability and serviceability of the cooling system can be improved.

The water pump is provided at the other end of the engine body in the axial direction of the crankshaft, and the suction pipe extends in the direction of the crankshaft, the engine cooling system further comprising a suction pipe connecting member for connecting the suction pipe to the water pump so as to allow the suction pipe to be displaceable in the axial direction of the crankshaft.

The suction pipe connecting member connects the suction pipe with the water pump so as to accommodate thermal expansion and contraction and dimensional errors of the suction pipe.

The water pump has a suction pipe insert portion, and the suction pipe connecting member is provided in the suction pipe insert portion.

The suction pipe is supported at opposite ends thereof only by the thermostat case and the suction pipe insert portion of the water pump.

The suction pipe and the thermostat case are formed with mating flanges to be fastened together.

The cooling water outlet port is formed at the other end of the engine body in the axial direction of the crankshaft, and the bypass pipe extends in the direction of the crankshaft, the engine cooling system further comprising a bypass pipe connecting member for connecting the bypass pipe to the cooling water outlet port so as to allow the bypass pipe to the displaceable in the axial direction of the crankshaft.

The bypass pipe connecting member connects the bypass pipe with the cooling water outlet port so as to accommodate thermal expansion and contraction and dimensional errors of the bypass pipe.

The cooling water outlet port has a bypass pipe insert portion, and the bypass pipe connecting member is provided in the bypass pipe insert portion.

The bypass pipe is supported at opposite ends thereof only by the thermostat case and the bypass pipe insert portion of the cooling water outlet port.

The bypass pipe comprises a small-diameter metal pipe member and a large-diameter rubber pipe member connected together.

As described above, the suction pipe is connected through the suction pipe connecting member to the water pump so as to be displaceable in the axial direction of the crankshaft of the engine body, and similarly the bypass pipe is connected through the bypass pipe connecting member to the cooling water outlet port so as to be displaceable in the axial direction of the crankshaft. Furthermore, no fixing positions or mounting points are provided at mid-portions of the suction pipe and the bypass pipe. Therefore, even in the case where coefficients of thermal expansion of the suction pipe and the bypass pipe are different from the coefficient of thermal expansion of the engine body, expansion or contraction can be absorbed, and dimensional errors also can be absorbed. Accordingly, the generation of internal stresses due to these causes can be prevented. Consequently, the sealability and durability of the cooling system can be improved.

The suction pipe connecting member comprises an O-ring, and the bypass pipe connecting member comprises an O-ring.

In the case where O-rings are used as the suction pipe connecting member and the bypass pipe connecting member, the O-rings can be very easily positioned since the assembly of the thermostat case, the suction pipe and the bypass pipe is fixed at a given position.

The engine body is a V-type engine body having a pair of banks which define a V-shaped space therebetween extending in the axial direction of the crankshaft, the assembly is mounted to the one end of the engine body in the axial direction of the crankshaft by fastening means, the water pump and the cooling water outlet port are provided at the other end of the engine body in the axial direction of the crankshaft, the suction pipe extends in the V-shaped space in the direction of the crankshaft and is connected to the water pump through the suction pipe connecting member allowing displacement of the suction pipe in the axial direction of the crankshaft, and the bypass pipe extends in the V-shaped space in the direction of the crankshaft and is connected to the cooling water outlet port through the bypass pipe connecting member allowing displacement of the bypass pipe in the axial direction of the crankshaft.

The crankshaft of the engine body extends in a transverse direction of a vehicle, the engine cooling system further comprising a cross flow type radiator provided forwardly of the engine body in offset relationship relative to the engine body in the transverse direction of the vehicle, the radiator having a cooling wind receiving portion extending in the transverse direction of the vehicle and having a pair of first and second cooling water tanks located at opposite ends of the cooling wind receiving portion in the transverse direction of the vehicle, a cooling fan mounted through a stay to a rear surface of an offset portion of the radiator behind which the engine body is not located, and a pair of first and second cooling water pipes for connecting the engine body to the first and second cooling water tanks, respectively, of the radiator, the first cooling water pipe being located between an upper end portion of the first cooling water tank and an upper portion of the engine body, while the second cooling water pipe being located between a lower end portion of the second cooling water tank and the upper portion of the engine body so as to extend along the stay.

According to the present invention for achieving the third object, there is provided an engine cooling system comprising an engine body having a crankshaft extending in a transverse direction of a vehicle, a cross flow type radiator provided forwardly of the engine body in offset relationship relative to the engine body in the transverse direction of the vehicle, the radiator having a cooling wind receiving portion extending in the transverse direction of the vehicle and having a pair of first and second cooling water tanks located at opposite ends of the cooling wind receiving portion in the transverse direction of the vehicle, and a cooling fan mounted through a stay to a rear surface of an offset portion of the radiator behind which the engine body is not located.

With this construction, the engine body is offset toward one side (which will be hereinafter referred to as a first side) of the vehicle in the transverse direction thereof, and the cooling fan is offset to the other side (which will be hereinafter referred to as a second side) of the vehicle in the transverse direction thereof. Accordingly, the engine body is not located behind the portion of the radiator at the second side of the vehicle. On the other hand, as the cooling fan is located just behind the portion of the radiator at the second side of the vehicle, and the engine body is not located behind the cooling fan, thereby greatly reducing blowing resistance of the cooling fan. Accordingly, the amount of blowing of the cooling fan can be greatly increased to thereby improved the cooling performance of the radiator. Although a transmission is located behind the cooling fan, it does not substantially hinder the blowing ability of the cooling fan because the height of the transmission is much lower than that of the engine body.

The engine cooling system further comprises a pair of first and second cooling water pipes for connecting the engine body to the first and second cooling water tanks, respectively of the radiator, the first cooling water pipe being located between an upper end portion of the first cooling water tank and an upper portion of the engine body, while the second cooling water pipe being located between a lower end portion of the second cooling water tank and the upper portion of the engine body so as to extend along the stay.

With this construction, the first cooling water pipe is located to connect a front end portion (adjacent the first side of the vehicle) of the engine body to the upper portion of the first cooling water tank located at the first side of the vehicle. Accordingly, the first cooling water pipe is not located behind the body portion of the radiator. Therefore, air flow behind the radiator is not hindered. In the cross flow type radiator, the second cooling water pipe is necessarily located behind the cooling fan. However, the second cooling water pipe is located behind and along the stay behind which air flow from the cooling fan is originally blocked. Therefore, the second cooling water pipe does not substantially hinder the air flow from the cooling fan. Accordingly, the amount of blowing by the cooling fan can be increased to thereby further improve the cooling performance of the radiator. Furthermore, as the velocity of the air flow around the second cooling water pipe is small, a wind noise is not generated to thereby reduce a noise of the cooling fan.

Further, the cooling fan operates to deflectionally pass air through the portion of the radiator at the second side of the vehicle. However, as the radiator is of the cross flow type, the cooling water is allowed to flow horizontally (in the transverse direction of the vehicle) in the radiator body portion. Therefore, the cooling water always passes the portion of the radiator at the second side of the vehicle and will to be strongly cooled by the cooling fan. Accordingly, the above-mentioned deflection of the air flow does not adversely affect the cooling performance of the radiator.

According to the present invention for achieving the first to third objects, there is provided an engine cooling system comprising an engine body having a plurality of cylinder banks and a crankshaft extending in a transverse direction of a vehicle, a plurality of water jackets communicated with each other for individually cooling the cylinder banks, a water pump provided at one end of the engine body in an axial direction of the crankshaft for supplying cooling water to the water jackets, a plurality of cooling water outlet ports formed at the one end of the engine body for discharging the cooling water from the water jackets, a cooling water passage comprising a plurality of branch portions respectively connected to the cooling water outlet ports and a joining portion convergently continued from the branch portions, the joining portion having a portion located at a highest position of an overall cooling water circulation path, a cooling water filler provided on the highest portion of the joining portion of the cooling water passage at a position near one of the cylinder banks, so as to admit cooling water into one of the water jackets for cooling the one cylinder bank near the cooling water filler and to expel inside air from the other water jackets for cooling the other cylinder banks, a thermostat case provided at the other end of the engine body in the axial direction of the crankshaft, a suction pipe extending in the direction of the crankshaft and having one end connected to the thermostat case and another end connected to the water pump, a bypass pipe extending in the direction of the crankshaft and having one end connected to the thermostat case and another end connected to the joining portion of the cooling water passage, the thermostat case, the suction pipe and the bypass pipe being constructed as an integrated assembly, fastening means for mounting the assembly to the other end of the engine body, a suction pipe connecting member for connecting the suction pipe to the water pump so as to allow the suction pipe to be displaceable in the axial direction of the crankshaft, a bypass pipe connecting member for connecting the bypass pipe to the joining portion of the cooling water passage so as to allow the bypass pipe to be displaceable in the axial direction of the crankshaft, a cross flow type radiator provided forwardly of the engine body in offset relationship relative to the engine body in the transverse direction of the vehicle, the radiator having a cooling wind receiving portion extending in the transverse direction of the vehicle and having a pair of first and second cooling water tanks at opposite ends of the cooling water receiving portion in the transverse direction of the vehicle, a cooling fan mounted through a stay to a rear surface of an offset portion of the radiator behind which the engine body is not located, a first cooling water pipe for connecting an upper end portion of the first cooling water tank located at one end of the radiator to the joining portion of the cooling water passage, and a second cooling water pipe for connecting a lower end portion of the second cooling water tank located at the other end of the radiator to the thermostat case so as to extend along the stay.

DETAILED DESCRIPTION OF THE PREFERRED EMBODIMENTS

A preferred embodiment of the present invention will now be described.

Figure 1:
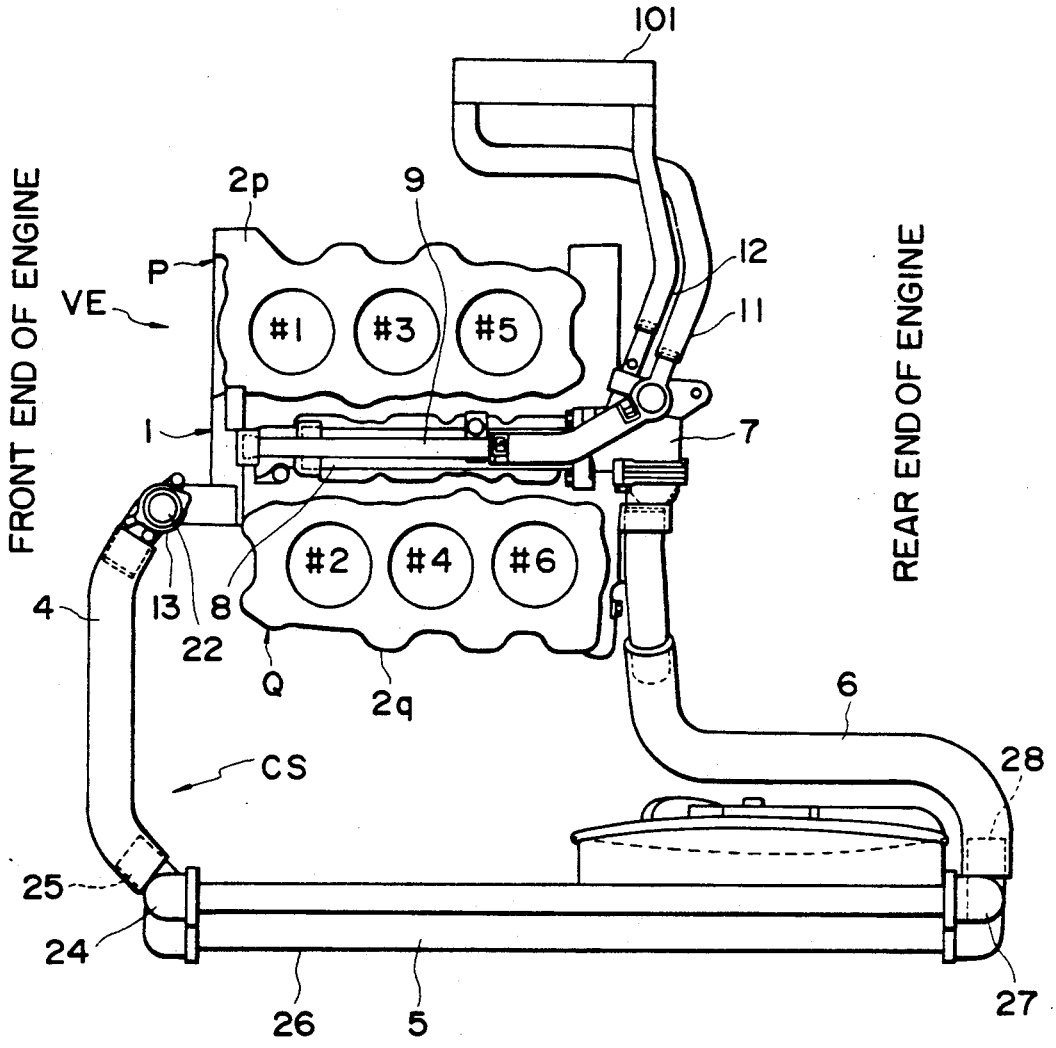
FIG. 1 is a top plan view of a preferred embodiment of the cooling system according to the present invention applied to a transverse 6-cylinder V-type engine.
Figure 2:
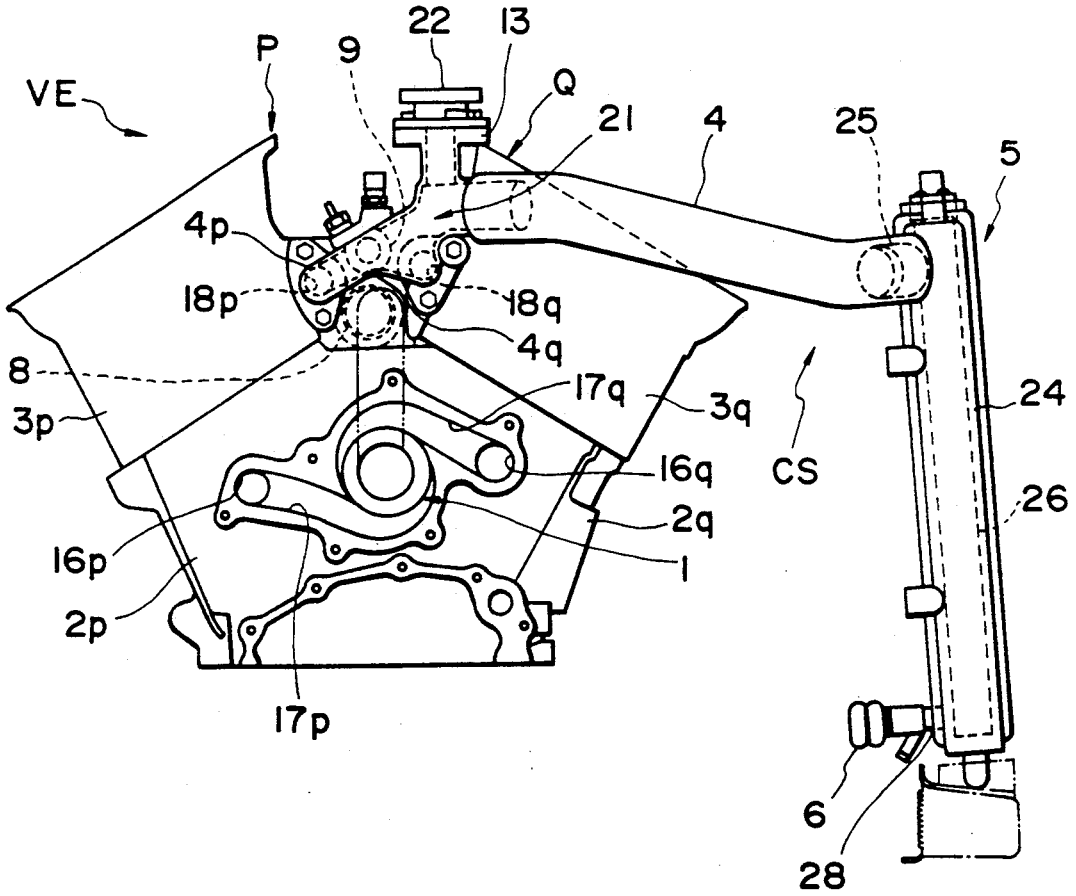
FIG. 2 is a front elevational view of the engine and the cooling system shown in FIG. 1 as viewed from the front side of the engine.
Figure 3:
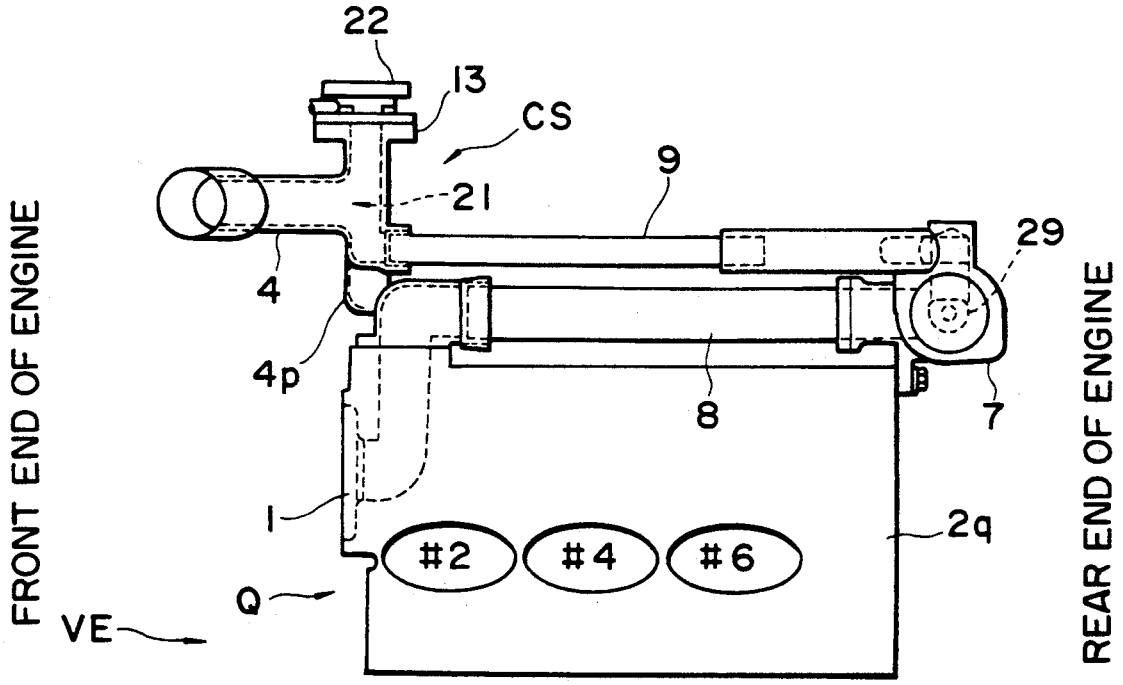
FIG. 3 is a side elevational view of the engine and the cooling system shown in FIG. 1.

As shown in FIGS. 1 to 3, a transverse mounted 6-cylinder V-type engine VE has cylinders arranged in a first bank P and second bank Q extending in a longitudinal direction of the engine VE. The first bank P includes first, third and fifth cylinders #1, #3 and #5 arranged in this order from a front side of the engine VE to a rear side thereof. The second bank Q includes second, fourth and sixth cylinders #2, #4 and #6 arranged in this order from the front side to the rear side of the engine VE. These first and second banks P and Q constitute cylinder lines or banks according to the present invention. The engine VE is to be mounted offset laterally in the direction of the engine front side from the longitudinal center line of a vehicle (i.e., the engine position is shifted in a horizontal direction to the left as viewed in FIG. 1 from the longitudinal center of the vehicle).

Figure 4:
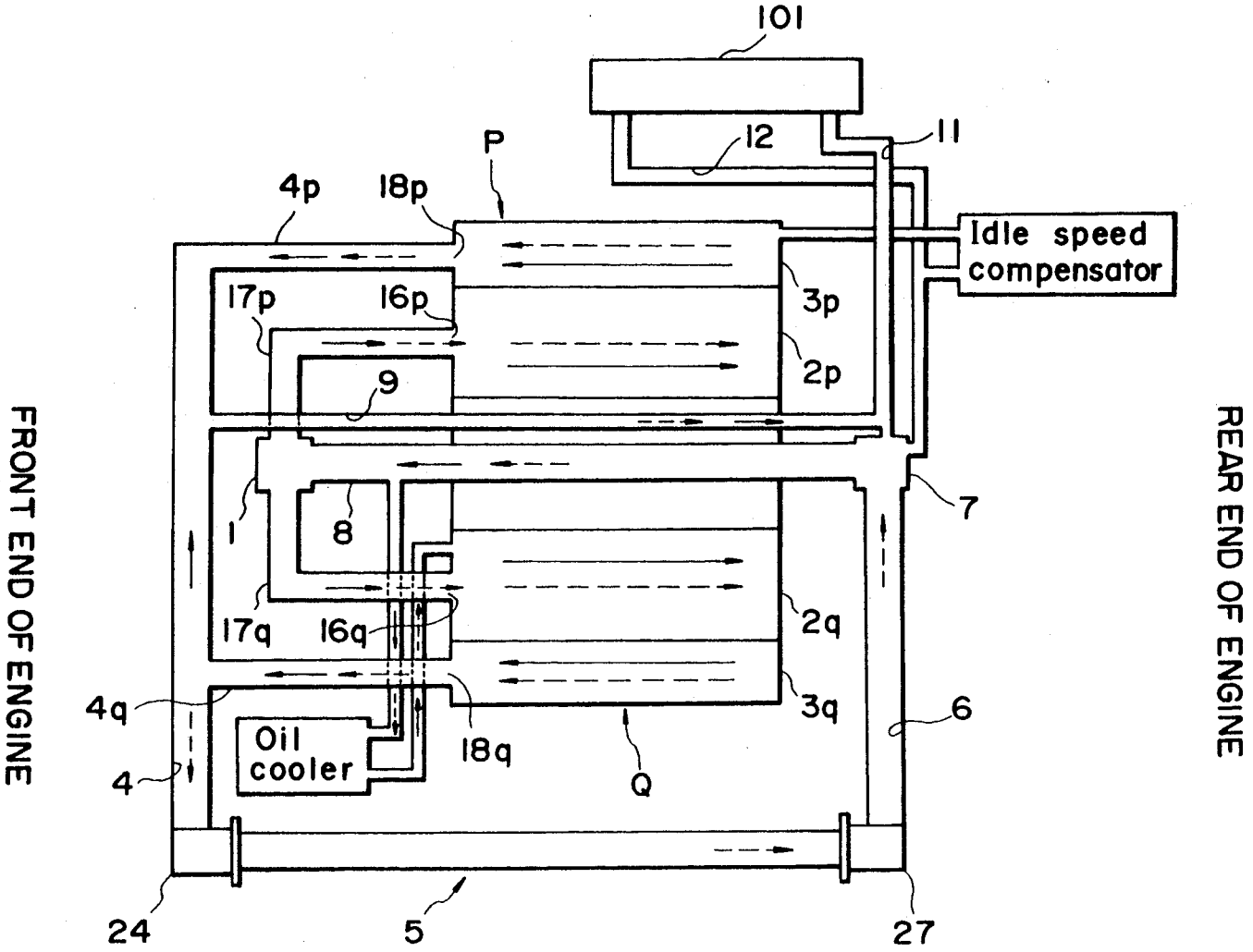
FIG. 4 is a schematic illustration of directions of flow of cooling water in the engine cooling system shown in FIG. 1.

A cooling system CS is provided to cool the engine VE. As shown in FIG. 4, the cooling system CS supplies cooling water discharged from a water pump 1 separately to the first bank P and the second bank Q. In the first bank P, the cooling water is fed to flow from a water jacket of a first cylinder block 2*p* to a water jacket of a first cylinder head 3*p*, and is then discharged to a first water outlet passage 4*p*. In the second bank Q, the cooling water is fed to flow from a water jacket of a second cylinder block 2*q* to a water jacket of a second cylinder head 3*q*, and is then discharged to a second water outlet passage 4*q*. The hot cooling water from the first and second water outlet passages 4*p* and 4*q* is fed to a radiator 5 through a common water outlet passage 4 as a collective passage of the first and second water outlet passages 4*p* and 4*q*. After being cooled in the radiator 5, the cooling water is returned through a water return passage 6, a thermostate case 7 and a suction passage 8 in this order to the water pump 1. The cooling system CS is basically constructed as mentioned above. Further, in order to prevent supercooling of the engine VE when a cooling water temperature is low, the cooling water from the first and second water outlet passages 4p and 4q is guided through a bypass passage 9 bypassing the radiator 5 to the thermostat case 7, and is then returned through the suction passage 8 to the water pump 1. The hot cooling water in the bypass passage 9 is partially supplied through a supply passage 11 to a heater 101 in a vehicle compartment. The cooling water discharged from the heater 101 is returned through a return passage 12 to the suction passage 8. As will be hereinafter described in detail, the second water outlet passage 4q is provided with a water filler 13 for filling cooling water into the cooling system CS at a position offset toward the second bank Q.

The construction and operation of each element of the cooling system CS will now be described.

The water pump 1 adapted to be rotationally driven by a crankshaft is located at an end portion of the engine VE on the front side thereof in a substantially central position between both of the banks P and Q in the transverse direction of the engine VE. The first and second cylinder blocks 2p and 2q are formed at their front ends with first and second water inlet ports 16p and 16q, respectively. The first and second water inlet ports 16p and 16q are connected through first and second water supply passages 17p and 17q to a discharge port of the water pump 1. Further, first and second water outlet ports 18p and 18q are formed on inner side surfaces of the first and second cylinder heads 3p and 3q, respectively, in the vicinity of the front ends thereof. The first and second water outlet ports 18p and 18q are connected to the first and second water outlet passages 4p and 4q, respectively.

The cooling water in the engine VE is allowed to flow in the following manner. First, the cooling water discharged from the water pump 1 flows from the first and second water inlet ports 16p and 16q located at the front end of the engine VE to the water jackets of the first and second cylinder blocks 2p and 2q, in which the cooling water flows toward the rear end of the engine VE. Then, in the vicinity of the rear end of the engine VE, the cooling water flows into the water jackets of the first and second cylinder heads 3p and 3q, in which the cooling water flows toward the front end of the engine VE. Then, the cooling water flows out from the first and second water outlet ports 18p and 18q located in the vicinity of the front end of the engine VE. Thus, the flow of the cooling water in the engine VE is a so-called return flow. In this manner, as the flow of the cooling water in the cylinder blocks 2p and 2q is counter to the flow of the cooling water in the cylinder heads 3p and 3q, the cylinders #1 to #6 can be uniformly cooled. Therefore, outputs from the cylinders #1 to #6 can be made uniform.

The first water outlet passage 4p and the second water outlet passage 4q are joined together at a joining portion 21 located above the first and second water outlet ports 18p and 18q. The joining portion 21 is connected to the common water outlet passage 4. The water filler 13 is provided at an upper wall of the joining portion 21 so that the cooling water may be filled into the second water outlet passage 4q at a position offset from the second bank Q. The water filler 13 is openably closed by a cap 22. The portion of the joining portion 21 where the water filler 13 is provided is at the highest position of the overall cooling water circulation path. Accordingly, the cooling water can be filled into the overall cooling water circulation path naturally by gravity. In this manner, as no water filler is provided on the radiator 5, an upper end of the radiator 5 need not be located at the highest position of the overall cooling water circulation path. Accordingly, a height of the radiator 5 can be sufficiently reduced to thereby effectively reduce the height of an engine hood of the vehicle. Although the water filler 13 is provided at the joining portion 21 in this preferred embodiment, it may be provided at the common water outlet passage 4.

As mentioned above, the water filler 13 is offset from the second bank Q so that cooling water may be filled into the second water outlet passage 4q. Accordingly, when filling cooling water from the water filler 13 after the cooling system CS has been drained, the cooling water filled from the water filler 13 flows through the second water outlet passage 4q and the second water outlet port 18q into the water jacket of the second cylinder head 3q. As the water jacket of the first cylinder block 2p and the water jacket of the second cylinder block 2q are communicated with each other at their lower portions, the cooling water having flowed into the water jacket of the second cylinder head 3q flows through the water jacket of the second cylinder block 2q and the water jacket of the first cylinder block 2p to the water jacket of the first cylinder head 3q. Thereafter, the cooling water flows into the radiator 5, the suction passage 8 and the bypass passage 9. In this manner, the cooling water is filled into the overall or entire cooling water circulation path.

In the course of filling the cooling water, when the cooling water flows into the water jacket of the second cylinder head 3q, inside air of a volume corresponding to that of the cooling water filled into the water jacket of the second cylinder head 3q is forced through the water jacket of the second cylinder block 2q, the water jacket of the first cylinder block 2p, the water jacket of the first cylinder head 3p and the first water outlet passage 4p where the cooling water does not substantially flow, and is discharged from the water filler 13 to the atmosphere. Accordingly, the cooling water flowing from the water filler 13 into the water jacket of the second cylinder head 3q does not interfere with the inside air in the second water outlet passage 4q even though passage 4q may have a relatively small diameter. As a result, the cooling water is allowed to smoothly flow into the water jacket of the second cylinder head 3q, and is thereafter smoothly filled into the overall cooling water circulation path in the above-mentioned order. Thus, the water filling ability of the cooling system CS can be improved by a simple construction that the water filler 13 is located at the joining portion 21 (or the common water outlet passage 4) at a position offset from the second bank Q.

The common water outlet passage 4 extends in a gently incline manner from an upstream end thereof connected to the joining portion 21 to a downstream end thereof at the radiator 5 substantially in a direction transverse to of the engine VE. The downstream end of the common water outlet passage 4 is connected to a water inlet port 25 provided in the vicinity of an upper end of an inlet tank 24 of the radiator 5.

A water outlet port 28 is provided in the vicinity of a lower end of an outlet tank 27 of the radiator 5. An upstream end of the water return passage 6 is connected to the water outlet port 28, and a downstream end of the water return passage 6 is connected to the thermostat case 7 fixed to an upper portion of the rear ends of the first and second cylinder blocks 2*p* and 2*q*. An upstream end of the suction passage 8 and a downstream end of the bypass passage 9 are connected to the thermostat case 7. A thermostat 29 is installed in the thermostat case 7. The thermostat 29 has a normal structure to be generally used. The thermostat 29 includes a wax pellet adapted to expand and contract according to changes in cooling water temperature. That is, when the cooling water temperature is high, the wax pellet expands to open the water return passage 6, thereby allowing the cooling water in the water return passage 6 to flow into the suction passage 8, and simultaneously close the bypass passage 9. In contrast, when the cooling water temperature is low, the wax pellet contracts to open the bypass passage 9, thereby allowing the cooling water in the bypass passage 9 to flow into the suction passage 8, and simultaneously close the water return passage 6.

The suction passage 8 is located on an upper surface between the cylinder blocks 2*p* and 2*q* in a V-shaped space defined between the first and second banks P and Q. The suction passage 8 extends from its upstream end connected to the thermostat case 7 toward the engine front side in the longitudinal direction of the engine VE, and a downstream end of the suction passage 8 is connected to the suction port of the water pump 1. The bypass passage 9 is located over the suction passage 8 along the same in the V-shaped space. Thus, as the suction passage 8 and the bypass passage 9 are located in the V-shaped space which is a dead space in the prior art, the cooling system CS can be made compact.

Figure 5:
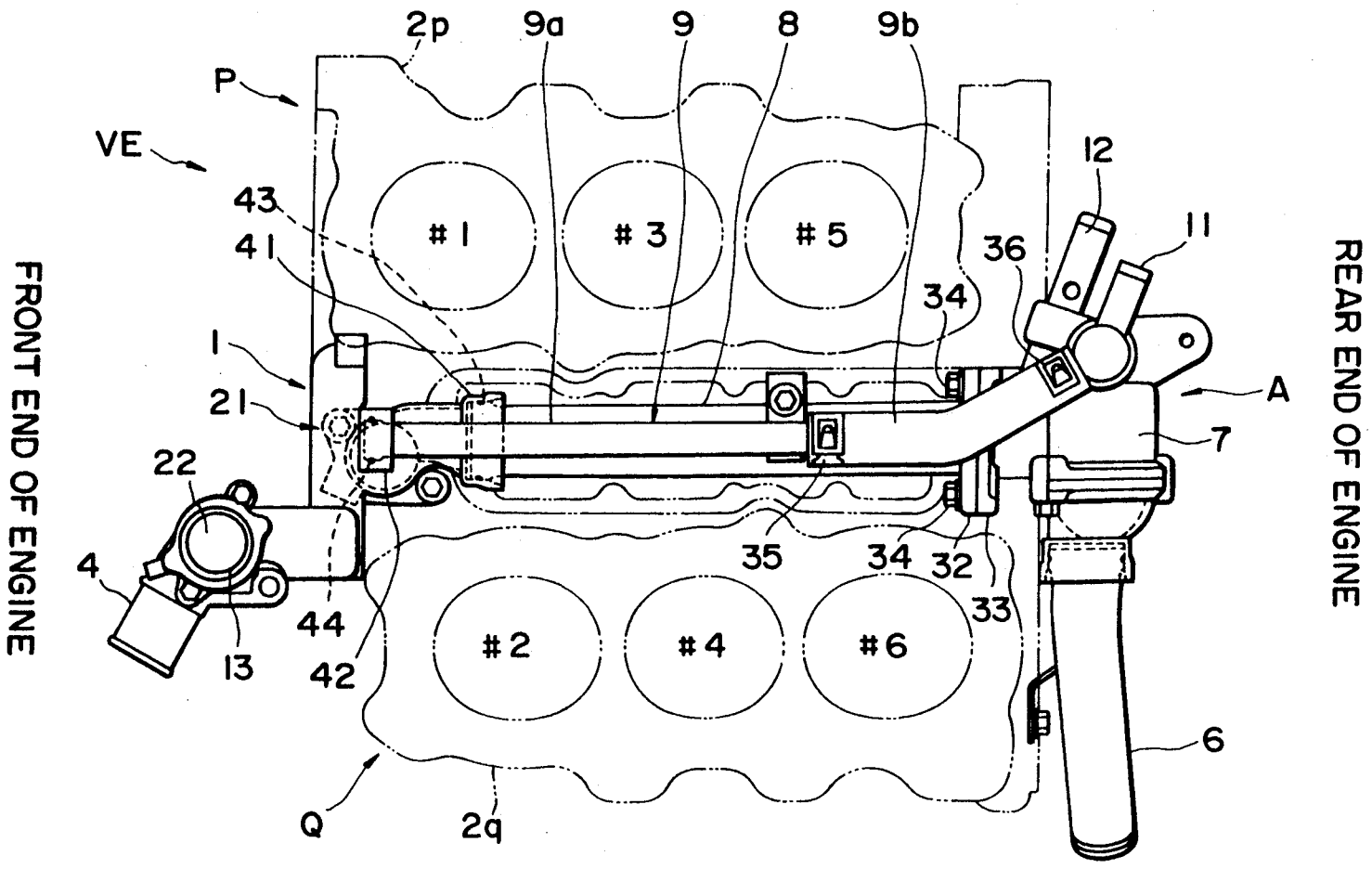
FIG. 5 is an enlarged top plan view of the engine shown in FIG. 1.
Figure 6:
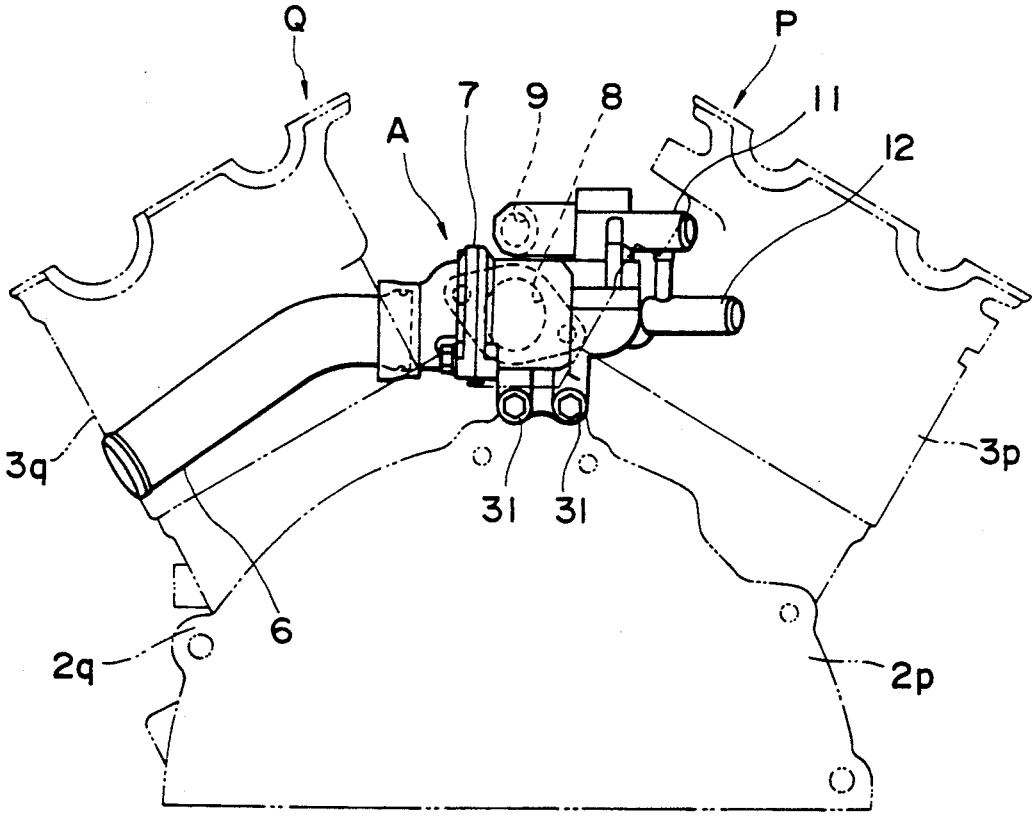
FIG. 6 is a rear elevational view of the engine and the cooling system shown in FIG. 1 as viewed from the rear side of the engine.

As shown in FIGS. 5 and 6, the thermostat case 7, the suction passage 8 and the bypass passage 9 are integrally constructed to form a compact assembly A. The thermostat case 7 is fastened to the rear end surfaces of the cylinder blocks 2*p* and 2*q* by two bolts 31 extending toward the engine front side. Accordingly, the thermostat case 7, the suction passage 8 and the bypass passage 9 can be mounted to the engine VE by a simple operation wherein the assembly A including the thermostat case 7 is mounted to the engine VE by the two bolts 31. Thus, the mountability of the cooling system CS can be greatly improved.

The suction passage 8 is formed of a metal material (e.g., iron). A first flange 32 is provided at the rear end of the suction passage 8. The first flange 32 is fastened to a second flange 33 provided at the front end of the thermostat case 7 by using bolts 34. Thus, the suction passage 8 is integrally connected to the thermostat case 7.

The bypass passage 9 is separately composed a small-diameter portion 9*a* formed of a metal material (e.g., iron) which portion 9*a* is located at the engine front side and a large-diameter portion 9*b* formed of an elastic material (e.g., rubber) which portion 9*b* is located at the engine rear side. The small-diameter portion 9*a* and the large-diameter portion 9*b* are fixedly connected together by inserting a rear end of the small-diameter portion 9*a* into a front end of the large-diameter portion 9*b* and clamping the outer circumference of the large-diameter portion 9*b* with a clamping member 35. A rear end of the large-diameter portion 9*b* is engaged with a bypass mounting portion (not shown) of the thermostat case 7, and the outer circumference of the large-diameter portion 9*b* is clamped by a clamping member 36, thereby integrally connecting the large-diameter portion 9*b* of the bypass passage 9 with the thermostat case 7.

The suction port of the water pump 1 is provided with a suction passage insert portion 41 into which the front end of the suction passage 8 is inserted. The joining portion 21 of the first and second water outlet passages 4*p* and 4*q* is provided with a bypass passage insert portion 42 into which the front end of the small-diameter portion 9*a* of the bypass passage 9 is inserted. After the front end of the suction passage 8 is inserted into the suction passage insert portion 41, the suction passage 8 and the suction passage insert portion 41 are connected and sealed together by a first O-ring 43 in such a manner that the suction passage 8 can be displaced within and relative to the insert portion 41 in the longitudinal direction of the engine VE. The first O-ring 43 constitutes a suction passage connecting member according to the present invention. On the other hand, after the front end of the bypass passage 9 is inserted into the bypass passage insert portion 42, the bypass passage 9 and the bypass passage insert portion 42 are connected and sealed together by a second O-ring 44 in such a manner that the bypass passage 9 can be displaced within the relative to the insert portion 42 in the longitudinal direction of the engine VE. The second O-ring 44 constitutes a bypass passage connecting member according to the present invention.

As mentioned above, the suction passage 8 and the bypass passage 9 are displaceable at the respective front ends thereof in the longitudinal direction of the engine VE. Accordingly, even when both the passages 8 and 9 are formed of a material having a coefficient of thermal expansion different from that of the engine VE, any expansion or contraction of the passages 8 and 9 or of the engine VE due to temperature changes can be absorbed by the displacement of the passages 8 and 9. Furthermore, errors of dimensions of the passages 8 and 9 can be absorbed by the displacement of the passages 8 and 9. Accordingly, the generation of internal stresses due to the above causes can be prevented. As a result, sealability and durability of the cooling system CS can be improved.

Furthermore, as the assembly A of the thermostat case 7, the suction passage 8 and the bypass passage 9 is fixed at a given position, the first and second O-rings 43 and 44 can be positioned very easily.

The radiator 5 is located in the vicinity of a front end of the vehicle in such a manner that a wind receiving surface of the radiator 5 extends over the substantially full width of the vehicle in a direction substantially perpendicular to the longitudinal direction of the vehicle. As previously mentioned, the engine VE is offset in the direction of the engine front side as viewed from the front side of the vehicle. Accordingly, the engine VE is located behind a substantially left half portion of the radiator 5 as viewed from the front side of the vehicle. In other words, the engine VE is not located behind a substantially right half portion of the radiator 5 as viewed from the front side of the vehicle.

Further, the radiator 5 is of a so-called cross flow type such that the inlet tank 24 and the outlet tank 27 are located at left and right ends of a radiator body portion 26 as viewed from the front side of the vehicle (i.e., the wind receiving surface of the radiator 5). The inlet tank 24 and the outlet tank 27 constitute cooling water tanks according to the present invention. Since the radiator 5 is of the cross flow type as mentioned above, a sufficient cooling area of the radiator body portion 26 can be ensured, and the total height of the radiator 5 can be reduced. To further reduce the height of radiator 5, the upper end portion of the radiator 5 is inclined to the engine VE. Such a reduction in total height of the radiator 5 effectively contributes to a reduction in height of the engine hood of the vehicle. The radiator 5 is fixed to a head frame 106 by using right and left mounting members 105.

A motor-driven cooling fan 107 adapted to force air rearwardly is provided just behind the substantially right half portion of the radiator 5 as viewed from the front side of the vehicle. The engine VE is not located behind the cooling fan 107. Accordingly, resistance to blowing of the cooling fan 107 can be made very small. As a result, the amount of blowing or the output of the cooling fan 107 can be increased to thereby improve cooling performance of the radiator 5. Although not shown, a transmission is located behind the cooling fan 107. However, the height of such transmission is very low, such that the blowing ability of the cooling fan 107 is not substantially influenced by the transmission.

The cooling fan 107 operates to pass air through the right half portion of the radiator body portion 26 as viewed from the front side of the vehicle. However, since the radiator 5 is of the cross flow type, the cooling water in the radiator body portion 26 flows substantially horizontally rightward and always passes the portion to be strongly cooled by the cooling fan 107. Accordingly, the above-mentioned deflection of air flow through the radiator body portion 26 has no influence upon the cooling performance of the radiator 5.

Meanwhile, in such a vehicle having the cross flow type radiator 5 and the transverse engine VE, the water return passage 6 is so arranged as to necessarily cross behind the cooling fan 107. As a result, in the prior art cooling system as mentioned previously, the water return passage 6 increases the resistance to blowing of the cooling fan 107 and generates a wind noise.

Figure 7:
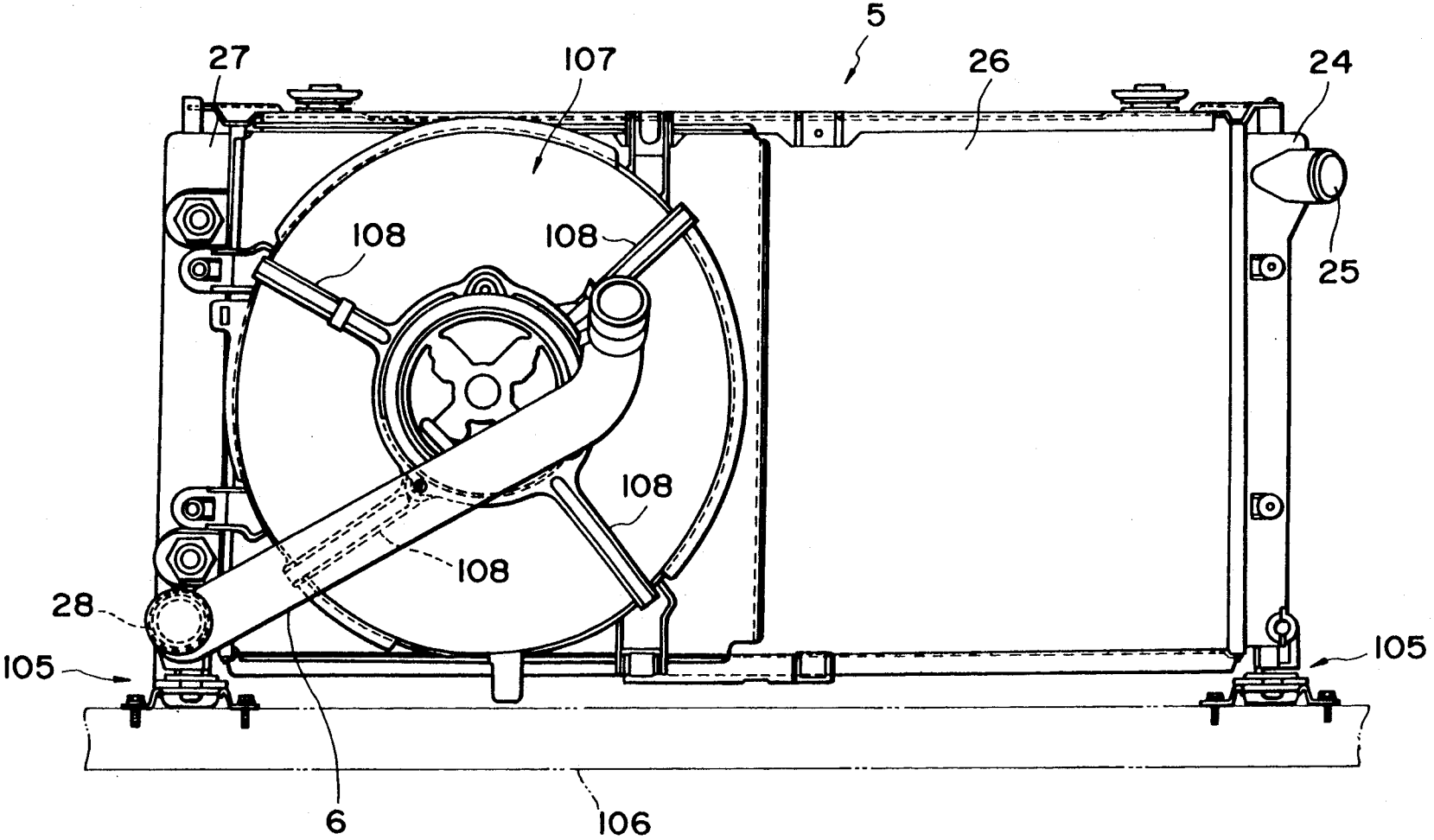
FIG. 7 is a rear elevational view of a radiator provided with a cooling fan in the engine cooling system shown in FIG. 1.

To prevent such a problem, as shown in FIG. 7, the water return passage 6 extends from its upstream end connected to the water outlet port 28 of the radiator 5 obliquely upwardly in the transverse direction of the vehicle so as to be disposed behind and along one of a number of stays 108 extending obliquely, that is, radially of the cooling fan 107. As the rearward air flow from the cooling fan 107 is originally hindered by the stays 108, the water return passage 6 disposed behind one of the stays 108 does not substantially hinder the rearward air flow from the cooling fan 107. Accordingly, the amount of blowing of the cooling fan 107 can be increased to thereby further improve the cooling performance of the radiator 5. Furthermore, as the velocity of the air flow around the water return passage 6 is small, no wind noise is generated and thus noise of the cooling fan 107 is reduced.

We claim

1. An engine cooling system comprising:

an engine body having a plurality of cylinder banks;

a plurality of water jackets communicated with each other for individually cooling said cylinder banks;

a cooling water passage comprising a plurality of branch portions connected to reflective said water jackets and a joining portion convergently continued from said branch portions; and a cooling water filler provided on said joining portion at a position near one of said cylinder banks.

2. The engine cooling system as defined in claim 1, wherein said joining portion of said cooling water passage has a portion located at a position higher than that of said branch portions of said cooling water passage, and said cooling water filler is provided at said higher portion.

3. The engine cooling system as defined in claim 2, wherein said portion where said cooling water filler is provided is to be located at a highest position of an overall cooling water circulation path.

4. The engine cooling system as defined in claim 1, wherein said cooling water filler is located nearer said one of said cylinder banks than other of said cylinder banks, thereby enabling cooling water to be admitted into said water jacket of said one cylinder bank near said cooling water filler and to expel inside air from said water jackets of said other of said cylinder banks.

5. The engine cooling system as defined in claim 1, wherein said cooling water filler is mounted on an upper surface of said joining portion of said cooling water passage.

6. The engine cooling system as defined in claim 1, further comprising a cap for openably closing said cooling water filler.

7. The engine cooling system as defined in claim 1, wherein each of said water jackets is formed continuously in a cylinder block and a cylinder head which constitutes each of said cylinder banks:

each said cylinder head has a cooling water outlet port for discharging cooling water from the respective said water jacket; and each of said branch portions of said cooling water passage is connected to a respective said cooling water oulet port.

8. The engine cooling system as defined in claim 7, wherein said cooling water outlet ports are formed close to each other between said cylinder banks.

9. The engine cooling system as defined in claim 7, wherein said joining portion of said cooling water passage is connected to a radiator.

10. The engine cooling system as defined in claim 9, wherein said joining portion of said cooling water passage is connected to a bypass passage connected to said cylinder block of said each said cylinder bank for bypassing said radiator.

11. The engine cooling system as defined in claim 1, wherein said engine body is a V-type engine body having a pair of said cylinder banks;

each of said water jackets is formed in a respective of said cylinder banks;

said joining portion of said cooling water passage has a portion located at a highest position of an overall cooling water circulation path; and said cooling water filler is provided on said highest portion of said cooling water passage at a position closer to one of said banks than to the other said bank, thereby enabling cooling water to be admitted into said water jacket in said one bank and to expel inside air from said water jacket in said other bank.

12. The engine cooling system as defined in claim 1, further comprising:

a thermostat case provided at one end of said engine body with respect to an axial direction of a crankshaft thereof;

a water pump and a cooling water outlet port provided at an opposite end of said engine body in the axial direction of the crankshaft;

a suction pipe provided to extend in the direction of the crankshaft for connecting said thermostat case to said water pump;

a bypass pipe provided to extend in the direction of the crankshaft for connecting said thermostat case to said cooling water outlet port;

said thermostat case, said suction pipe and said bypass pipe being constructed as a unit mounted on said engine body;

fastening means for mounting said assembly to said one end of said engine body;

a suction pipe connecting member for connecting said suction pipe to said water pump so as to allow said suction pipe to be displaced in the axial direction of the crankshaft; and a bypass pipe connecting member for connecting said bypass pipe to said cooling water outlet port so as to allow said bypass pipe to be displaced in the axial direction of the crankshaft.

13. The engine cooling system as defined in claim 1, further comprising:

a crankshaft provided in said engine body to extend in a transverse direction of a vehicle;

a cross flow type radiator provided forwardly of said engine body in offset relationship relative to said engine body in the transverse direction of the vehicle, said radiator having a cooling wind receiving portion to extend in the transverse direction of the vehicle and having a pair of first and second cooling water tanks located at opposite ends of said radiator in the transverse direction of the vehicle;

a cooling fan mounted through a stay to a rear surface of an offset portion of said radiator behind which said engine body is not located; and a pair of first and second cooling water pipes for connecting said engine body to said first and second cooling water tanks of said radiator, respectively, said first cooling water pipe being located between an upper end portion of said first cooling water tank and an upper portion of said engine body, while said second cooling water pipe being located between a lower end portion of said second cooling water tank and said upper portion of said engine body so as to extend along said stay.

14. An engine cooling system comprising:

a thermostat case to be provided at one end of an engine body with respect to an axial direction of a crankshaft thereof;

a water pump and a cooling water outlet port to be provided at another end of the engine body with respect to the axial direction of the crankshaft;

a suction pipe to be positioned to extend in the axial direction of the crankshaft, said suction pipe having one end connected to said thermostat case and another end connected to said water pump through a suction pipe connecting member allowing displacement of said suction pipe in the axial direction of the crankshaft; and a bypass pipe to be positioned to extend in the axial direction of the crankshaft, said bypass pipe having one said end connected to said thermostat case and another end connected to said cooling water outlet port through a bypass pipe connecting member allowing displacement of said bypass pipe in the axial direction of the crankshaft, said bypass pipe comprising a smaller diameter metal pipe member and a larger diameter rubber pipe member connected together;

wherein said thermostat case, said suction pipe and said bypass pipe are constructed as a unit mountable on the engine body.

15. The engine cooling system as defined in claim 14, further comprising fastening means for mounting said assembly to the engine body.

16. The engine cooling system as defined in claim 15, wherein said fastening means comprises a bolt to extend from the one end of the engine body toward the another end thereof in the axial direction of the crankshaft for fastening said thermostat case to a side wall surface of the one end of the engine body.

17. The engine cooling system as defined in claim 14, wherein said suction pipe connecting member connects said suction pipe with said water pump so as to accommodate thermal extension/contraction and dimensional errors of said suction pipe.

18. The engine cooling system as defined in claim 17, wherein said water pump has a suction pipe insert portion, and said suction pipe connecting member is provided in said suction pipe insert portion.

19. The engine cooling system as defined in claim 18, wherein said suction pipe is supported at opposite ends thereof only to said thermostat case and said suction pipe insert portion of said water pump.

20. The engine cooling system as defined in claim 14, wherein said suction pipe and said thermostat case are formed with mating flanges to be fastened together.

21. The engine cooling system as defined in claim 14, wherein said bypass pipe connecting member connects said bypass pipe with said cooling water outlet port so as to accommodate thermal extension/contraction and dimensional errors of said bypass pipe.

22. The engine cooling system as defined in claim 21, wherein said cooling water outlet port has a bypass pipe insert portion, and said bypass pipe connecting member is provided in said bypass pipe insert portion.

23. The engine cooling system as defined in claim 22, wherein said bypass pipe is supported at opposite ends thereof only to said thermostat case and said bypass pipe insert portion of said cooling water outlet port.

24. The engine cooling system as defined in claim 14, wherein said suction pipe connecting member comprises an O-ring.

25. The engine cooling system as defined in claim 14, wherein said bypass pipe connecting member comprises an O-ring.

26. The engine cooling system as defined in claim 14, further comprising a V-type said engine body having a pair of cylinder banks which define therebetween a V-shaped space extending in the axial direction of said crankshaft;

said assembly is mounted to the one end of said engine body with respect to the axial direction of said crankshaft by fastening means;

said water pump and said cooling water outlet port are provided at the another end of said engine body with respect to the axial direction of said crankshaft;

said suction pipe and said bypass pipe extend in said V-shaped space in the direction of said crankshaft.

27. The engine cooling system as defined in claim 14, wherein the crankshaft of the engine body is to extend in a transverse direction of a vehicle, said engine cooling system further comprising:

a cross flow type radiator to be positioned forwardly of the engine body in offset relationship relative to the engine body in the transverse direction of the vehicle, said radiator having a cooling wind receiving portion to extend in the transverse direction of the vehicle and having a pair of first and second cooling water tanks to be located at opposite ends of said radiator in the transverse direction of the vehicle;

a cooling fan mounted through a stay to a rear surface of an offset portion of said radiator behind which the engine body is not to be located; and a pair of first and second cooling water pipes for connecting the engine body to said first and second cooling water tanks of said radiator, respectively, said first cooling water pipe to be located between an upper end portion of said first cooling water tank and an upper portion of the engine body, while said second cooling water pipe to be located between a lower end portion of said second cooling water tank and the upper portion of the engine body so as to extend along said stay.

28. An engine cooling system comprising:

an engine body having a crankshaft extending in a direction to be transverse of a vehicle;

a cross flow type radiator provided forwardly of said engine body in offset relationship relative to said engine body in the transverse direction of the vehicle, said radiator having a cooling wind receiving portion extending in the transverse direction of the vehicle and having a pair of first and second cooling water tanks located at opposite ends of said radiator in the transverse direction of the vehicle; and a cooling fan mounted through a stay to a rear surface of an offset portion of said radiator behind which said engine body is not located.

29. The engine cooling system as defined in claim 28, further comprising a pair of first and second cooling water pipes for connecting said engine body to said first and second cooling water tanks of said radiator, respectively, said first cooling water pipe being located between an upper end portion of said first cooling water tank and an upper portion of said engine body, while said second cooling water pipe being located between a lower end portion of said second cooling water tank and said upper portion of said engine body so as to extend along said stay.

30. An engine cooling system comprising:

an engine body having a crankshaft extending in a direction to be transverse of a vehicle and a plurality of cylinder banks;

a plurality of water jackets communicated with each other for individually cooling said cylinder banks;

a water pump provided at one end of said engine body with respect to an axial direction of said crankshaft for supplying cooling water to said water jackets;

a plurality of cooling water outlet ports formed at said one end of said engine body for discharging cooling water from said water jackets;

a cooling water passage comprising a plurality of branch portions connected to respective said cooling water outlet ports and a joining portion convergently continued from said branch portions, said joining portion having a portion to be located at a highest position of an overall cooling water circulation path;

a cooling water filler provided on said highest portion of said joining portion of said cooling water passage at a position nearer to one of said cylinder banks than other said cylinder banks, thereby enabling cooling water to be admitted into one said water jacket of said one cylinder bank near said cooling water filler and to expel inside air from said water jackets of said other cylinder banks;

a thermostat case provided at the other end of said engine body with respect to said axial direction of said crankshaft;

a suction pipe extending axially along said crankshaft and having one end connected to said thermostat case and another end connected to said water pump;

a bypass pipe extending axially along said crankshaft and having one end connected to said thermostat case and another end connected to said joining portion of said cooling water passage;

said thermostat case, said suction pipe and said bypass pipe being constructed as a unit mounted on said engine body;

fastening means for mounting said assembly to said other end of said engine body;

a suction pipe connecting member connecting said suction pipe to said water pump so as to allow said suction pipe to be displaced in said axial direction of said crankshaft;

a bypass pipe connecting member connecting said bypass pipe to said joining portion of said cooling water passage so as to allow said bypass pipe to be displaced in said axial direction of said crankshaft;

a cross flow type radiator provided forwardly of said engine body in offset relationship relative to said engine body in the transverse direction of the vehicle, said radiator having a cooling wind receiving portion to extend in the transverse direction of the vehicle and having a pair of first and second cooling water tanks at opposite ends of said radiator in the transverse direction of the vehicle;

a cooling fan mounted through a stay to a rear surface of an offset portion of said radiator behind which said engine body is not located;

a first cooling water pipe connecting an upper end portion of said first cooling water tank located relatively adjacent said one end of said engine body to said joining portion of said cooling water passage; and a second cooling water pipe connecting a lower end portion of said second cooling water tank located relatively adjacent said other end of said engine body to said thermostat case so as to extend along said stay.

31. An engine cooling system comprising:

a thermostat case to be provided at one end of an engine body with respect to an axial direction of a crankshaft thereof that is to extend in a direction transverse of a vehicle;

a water pump and a cooling water outlet port to be provided at another end of the engine body with respect to the axial direction of the crankshaft;

a suction pipe to be positioned to extend in the axial direction of the crankshaft, said suction pipe having one end connected to said thermostat case and another end connected to said water pump through a suction pipe connecting member allowing displacement of said suction pipe in the axial direction of the crankshaft;

a bypass pipe to be positioned to extend in the axial direction of the crankshaft, said bypass pipe having one end connected to said thermostat case and another end connected to said cooling water outlet port through a bypass pipe connecting member allowing displacement of said bypass pipe in the axial direction of the crankshaft;

wherein said thermostat case, said suction pipe and said bypass pipe are constructed as a unit mountable on the engine body;

a cross flow type radiator to be positioned forwardly of the engine body in offset relationship relative to the engine body in the transverse direction of the vehicle, said radiator having a cooling wind receiving portion to extend in the transverse direction of the vehicle and having a pair of first and second cooling water tanks to be located at opposite ends of said radiator in the transverse direction of the vehicle;

a cooling fan mounted through a stay to a rear surface of an offset portion of said radiator behind which the engine body is not to be located; and a pair of first and second cooling water pipes for connecting the engine body to said first and second cooling water tanks of said radiator, respectively, said first cooling water pipe to be located between an upper end portion of said first cooling water tank and an upper portion of the engine body, while said second cooling water pipe to be located between a lower end portion of said second cooling water tank and the upper portion of the engine body so as to extend along said stay.

32. The engine cooling system as defined in claim 31, further comprising fastening means for mounting said assembly to the engine body.

33. The engine cooling system as defined in claim 32, wherein said fastening means comprises a bolt to extend from the one end of the engine body toward the another end thereof in the axial direction of the crankshaft for fastening said thermostat case to a side wall surface of the one end of the engine body.

34. The engine cooling system as defined in claim 31, wherein said suction pipe connecting member connects said suction pipe with said water pump so as to accommodate thermal extension/contraction and dimensional errors of said suction pipe.

35. The engine cooling system as defined in claim 34, wherein said water pump has a suction pipe insert portion, and said suction pipe connecting member is provided in said suction pipe insert portion.

36. The engine cooling system as defined in claim 35, wherein said suction pipe is supported at opposite ends thereof only to said thermostat case and said suction pipe insert portion of said water pump.

37. The engine cooling system as defined in claim 31, wherein said suction pipe and said thermostat case are formed with mating flanges to be fastened together.

38. The engine cooling system as defined in claim 31, wherein said bypass pipe connecting member connects said bypass pipe with said cooling water outlet port so as to accommodate thermal extension/contraction and dimensional errors of said bypass pipe.

39. The engine cooling system as defined in claim 38, wherein said cooling water outlet port has a bypass pipe insert portion, and said bypass pipe connecting member is provided in said bypass pipe insert portion.

40. The engine cooling system as defined in claim 39, wherein said bypass pipe is supported at opposite ends thereof only to said thermostat case and said bypass pipe insert portion of said cooling water outlet port.

41. The engine cooling system as defined in claim 31, wherein said suction pipe connecting member comprises an O-ring.

42. The engine cooling system as defined in claim 31, wherein said bypass pipe connecting member comprises an O-ring.

43. The engine cooling system as defined in claim 31, further comprising a V-type said engine body having a pair of cylinder banks which define therebetween a V-shaped space extending in the axial direction of said crankshaft;

said assembly is mounted to the one end of said engine body with respect to the axial direction of said crankshaft by fastening means;

said water pump and said cooling water outlet port are provided at the another end of said engine body with respect to the axial direction of said crankshaft;

said suction pipe and said bypass pipe extend in said V-shaped space in the direction of said crankshaft.

* * * * *